US010464197B2

(12) United States Patent
McNeill et al.

(10) Patent No.: US 10,464,197 B2
(45) Date of Patent: Nov. 5, 2019

(54) CARTON CLOSING TOOL HAVING TOOL-FREE ADJUSTMENT MEMBERS

(71) Applicant: STANLEY FASTENING SYSTEMS, L.P., North Kingstown, RI (US)

(72) Inventors: Brian McNeill, Warwick, RI (US); Jonathan D. Kalow, East Greenwich, RI (US)

(73) Assignee: STANLEY FASTENING SYSTEMS, L.P., North Kingstown, RI (US)

( * ) Notice: Subject to any disclaimer, the term of this patent is extended or adjusted under 35 U.S.C. 154(b) by 734 days.

(21) Appl. No.: 13/844,785

(22) Filed: Mar. 15, 2013

(65) Prior Publication Data

US 2014/0001227 A1 Jan. 2, 2014

Related U.S. Application Data

(60) Provisional application No. 61/665,744, filed on Jun. 28, 2012.

(51) Int. Cl.
*B25C 5/02* (2006.01)
*B25C 5/16* (2006.01)

(52) U.S. Cl.
CPC ..... *B25C 5/1606* (2013.01); *B25C 5/02* (2013.01); *B25C 5/0271* (2013.01)

(58) Field of Classification Search
CPC .... B25C 5/0207; B25C 5/0264; B25C 5/0271
USPC ..... 227/120, 155
See application file for complete search history.

(56) References Cited

U.S. PATENT DOCUMENTS 2,897,502 A * 8/1959 Schafroth ..... B25C 5/0264 227/108
2,899,679 A * 8/1959 Allen ..... B65B 51/05 227/108
2,989,948 A * 6/1961 Forrester ..... B27F 7/34 173/169
3,191,841 A * 6/1965 Schafroth ..... B25C 1/041 227/108
3,403,832 A * 10/1968 Pabich ..... B21F 45/24 227/108
3,504,837 A * 4/1970 Cairatti ..... B25C 5/0264 227/108
4,335,841 A 6/1982 Fogarasy
4,524,897 A 6/1985 Bachmann
4,574,992 A 3/1986 Holman
4,583,600 A * 4/1986 Smith, III ..... B25C 1/06 173/124
4,597,518 A * 7/1986 Paul ..... B25C 1/003 227/120

(Continued)

OTHER PUBLICATIONS

Extended European Search Report dated Jan. 2, 2017 in corresponding European Patent Application No. 13173570.6.

*Primary Examiner* — Thanh K Truong
*Assistant Examiner* — Patrick B Fry
(74) *Attorney, Agent, or Firm* — Pillsbury Winthrop Shaw Pittman LLP

(57) ABSTRACT

Tool-free adjustment members in a fastener driving tool. The fastener driving tool can be used to seal closed containers such as, for example, corrugated fiberboard cartons, by applying staples to the folded flaps or other closure parts to secure them in place. The tool-free adjustment members provide customizable drive settings for a variety of different sized staples and different workpiece conditions.

11 Claims, 9 Drawing Sheets

(56) References Cited

U.S. PATENT DOCUMENTS

| | | | | |
|---|---|---|---|---|
| 4,671,444 | A * | 6/1987 | Oliver | B25C 5/0271 227/108 |
| 4,716,813 | A * | 1/1988 | Prudencio | B25C 5/13 227/130 |
| 5,118,023 | A | 6/1992 | Fushiya et al. | |
| 5,785,227 | A | 7/1998 | Akiba | |
| 6,050,471 | A | 4/2000 | Yagi | |
| 6,604,666 | B1 * | 8/2003 | Pedicini | B25C 1/06 173/124 |
| 7,159,748 | B2 | 1/2007 | Gerlach et al. | |
| 7,422,134 | B2 | 9/2008 | Aguirre et al. | |
| 7,427,008 | B2 | 9/2008 | Brendel et al. | |
| 7,537,145 | B2 | 5/2009 | Gross et al. | |
| 7,644,850 | B2 | 1/2010 | Gerlach et al. | |
| 7,665,540 | B2 | 2/2010 | Gross et al. | |
| 7,677,425 | B2 | 3/2010 | Brendel et al. | |
| 7,748,586 | B2 | 7/2010 | Akiba | |
| 7,753,243 | B2 | 7/2010 | Brendel et al. | |
| 7,909,217 | B2 | 3/2011 | Aguirre et al. | |
| 7,913,890 | B2 | 3/2011 | Gross et al. | |
| 7,918,374 | B2 | 4/2011 | Gardner et al. | |
| 8,225,978 | B2 | 7/2012 | Gross et al. | |
| 2006/0231582 | A1 | 10/2006 | Hong et al. | |
| 2009/0057366 | A1 | 3/2009 | Braddock | |
| 2011/0000949 | A1 | 1/2011 | Ito et al. | |
| 2011/0180580 | A1 | 7/2011 | Gardner et al. | |
| 2012/0085809 | A1 | 4/2012 | Milo | |
| 2012/0160889 | A1 | 6/2012 | Tanji | |

* cited by examiner

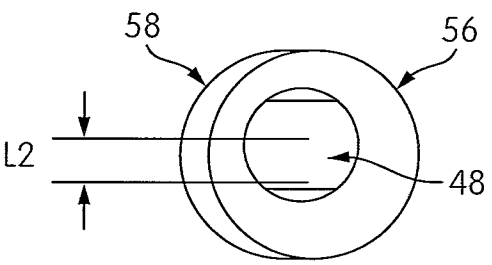
FIG. 11
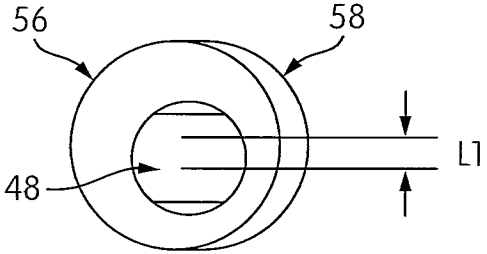
FIG. 10
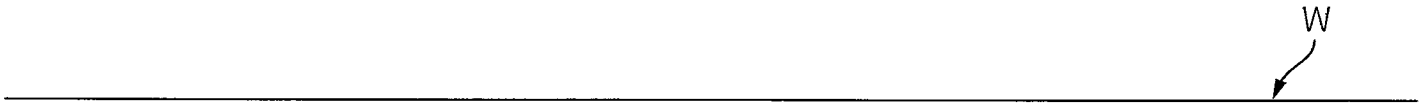

CARTON CLOSING TOOL HAVING TOOL-FREE ADJUSTMENT MEMBERS

CROSS-REFERENCE TO RELATED APPLICATIONS

This application claims the benefit of priority from U.S. Provisional Patent Application No. 61/665,744, filed on Jun. 28, 2012, the content of which is incorporated by reference in its entirety.

FIELD

This invention relates to fastener driving tools and more particularly to fastener driving tools including clinching mechanisms.

BACKGROUND

Power operated fastener driving tools are traditionally used in industrial applications where compressed air provides a convenient power source. Because of the nature of the compressed air power source and the expense involved in heavy duty industrial fastener driving tools, such tools are generally not suitable for use in fastening jobs where maneuvering is required, space is limited, or compressed air is not available. Manually operated fastener driving tools are also used in industrial applications. However, in many of the jobs where manually operated fastener driving tools are used, considerable operator fatigue may be involved because a manual fastener driving tool requires a large user actuation force.

SUMMARY

A carton closing tool of the embodiments herein includes adjustment members that adjust the tool to accommodate various staple sizes and tool drive characteristics without requiring the use of hand tools. The present invention incorporates these tool free adjustment members in a stapling tool for blind fastening of cardboard, typically packing boxes. Tools of this type contain a set of two movable anvils as part of a mechanism, such that when a staple is driven, the anvils penetrate the cardboard workpiece to clinch the staple legs and are subsequently automatically retracted.

Packaging tools commonly include different adjustment devices that can affect at least one of the following: the staple leg length accepted by the tool, the tightness of the clinch, and the depth of drive. Most existing adjustment members require hand tools to actuate the adjustment members. In the embodiments described herein, the same adjustments can be made with the novel adjustment members of the present invention that do not require hand tools for adjustment.

According to an aspect of the invention, there is provided fastener driving tool, comprising: a housing; a drive track within the housing; a magazine connected to the housing and configured to hold a supply of fasteners and to provide a leading fastener to the drive track; a driver configured to move downward in the drive track and drive the leading fastener into a workpiece during a drive stroke, and upward in the drive track during a return stroke; a mount connected to the driver; a clinching assembly operatively connected to the housing and to the mount, the clinching assembly being configured to engage the leading fastener during the drive stroke and move into a clinching position at the end of the drive stroke to clinch the fastener to the workpiece; and an adjuster configured to adjust the clinching assembly to accommodate fasteners having different lengths.

BRIEF DESCRIPTION OF THE DRAWINGS

The numerous advantages of the present invention may be better understood by those skilled in the art by reference to the accompanying figures. In the drawings, like reference numerals designate corresponding parts throughout the several views.

FIG. 10 illustrates a front view of the leg length adjustment cam lobes for a first leg setting;

FIG. 11 illustrates a front view of the leg length adjustment cam lobes for a second leg setting;

DETAILED DESCRIPTION OF THE INVENTION

Reference will now be made in detail to the present embodiments of the invention, examples of which are illustrated in the accompanying drawings.

Figure 1:
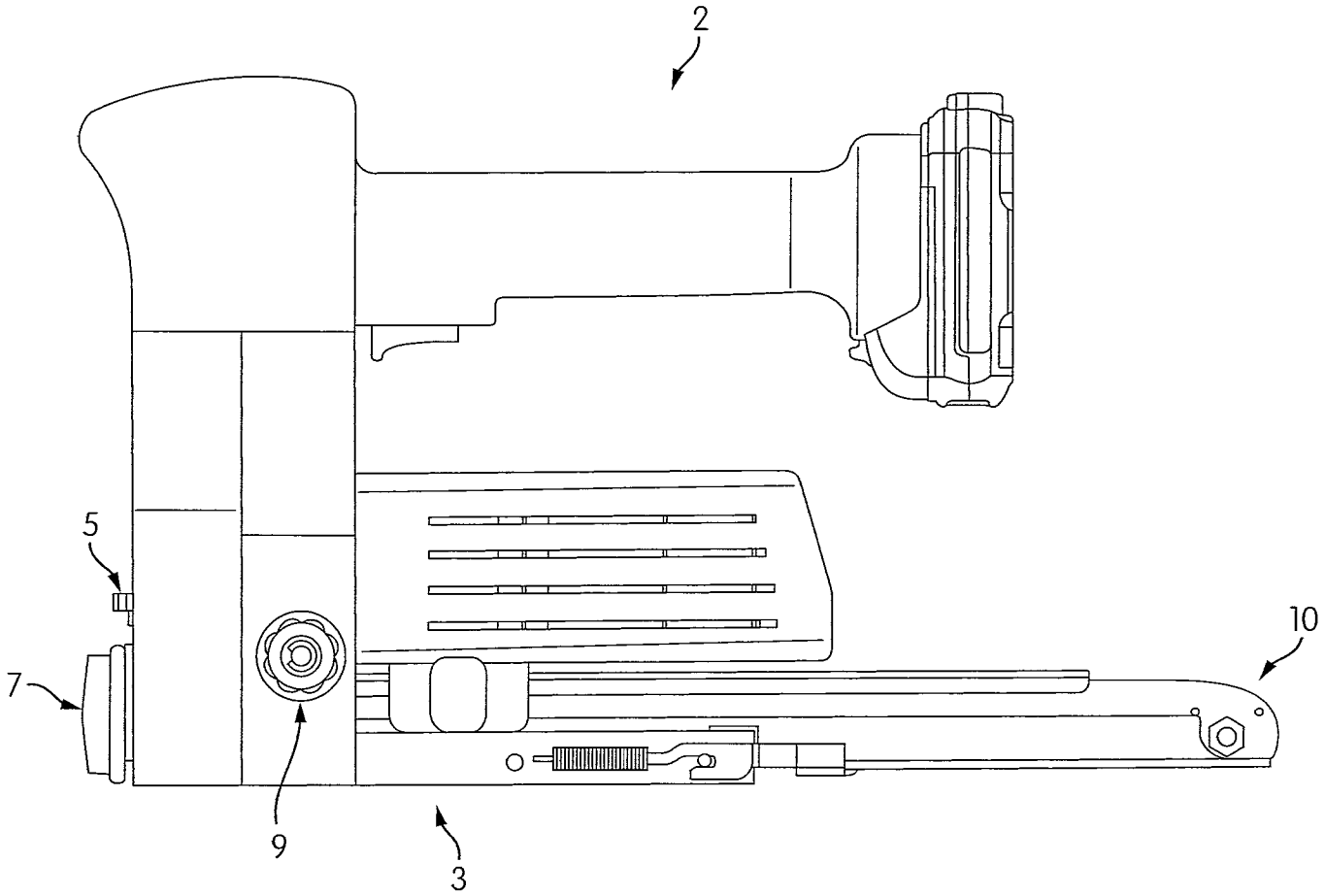
FIG. 1 illustrates an exemplary fastener driving tool constructed in accordance with the teachings of the present disclosure.

FIG. 1 illustrates an embodiment of the fastener driving or carton closing tool. Attaching to the tool body 2 is a removable magazine 10 which stores the fasteners, such as staples, prior to driving, and a tool base 3 that contacts the workpiece surface during use.

Figure 2:
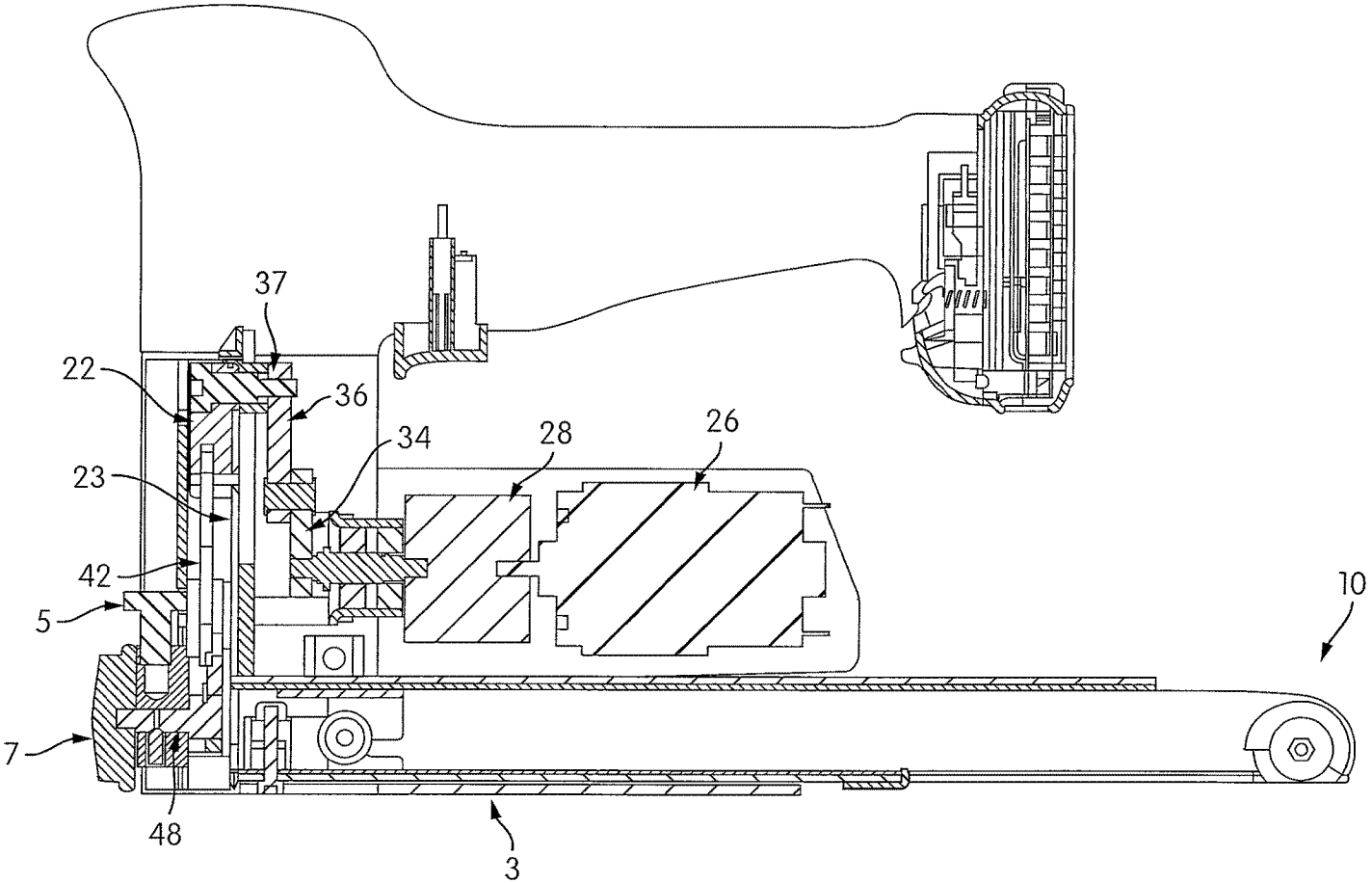
FIG. 2 illustrates a cross-sectional view of the fastener driving tool of the embodiment of FIG. 1.

As shown in FIGS. 1 and 2, the tool includes a variable clinch adjustment thumbwheel 5 that controls the downstroke position of the clincher arms in the clinching assembly of the tool. The variable clinch adjustment thumbwheel 5 has a gripping surface with grooves that allow the user to securely grasp the thumbwheel. By turning the thumbwheel, in a first direction or a second direction, the tool increases or decreases the space between the clinching arms in the downstroke, and thereby increases or decreases the tightness of the formed staple legs.

Another adjustment member is a positionable leg length adjustment dial 7. The dial 7 is rotatable and changes the pivot axis of the clincher arms of the clincher assembly between a first setting for a staple having a first length to a second setting for a staple having a second length without the use of hand tools.

A further adjustment member is a depth of drive dial 9. The depth of drive dial rotates between a range of positions to change how deep the staple can be fired to penetrate the workpiece.

FIG. 2 shows a cross-sectional view of the tool illustrating the crank arm 34 and the motor 26 that provides power to the tool for driving the staple. Power from the motor is transferred through a gear reduction mechanism 28 to a crank arm 34 and connecting rod 36. The connecting rod 36 is linked to a driver mounting block 22, on which is mounted the driver blade 23 and a clincher linkage 42 of a clinching assembly 40.

Figure 3:
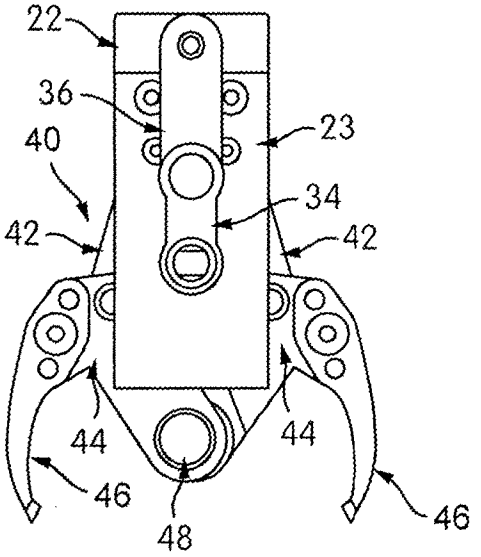
FIG. 3 illustrates the fastener closing mechanism of the embodiment of FIG. 1 in the open position.
Figure 4:
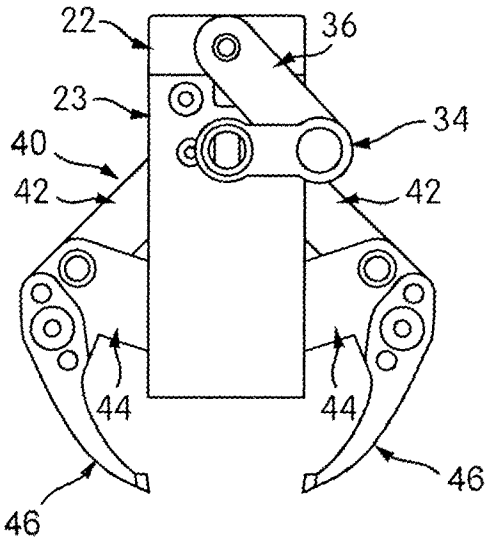
FIG. 4 illustrates the fastener closing mechanism of the embodiment of FIG. 1 at the beginning of actuation.
Figure 5:
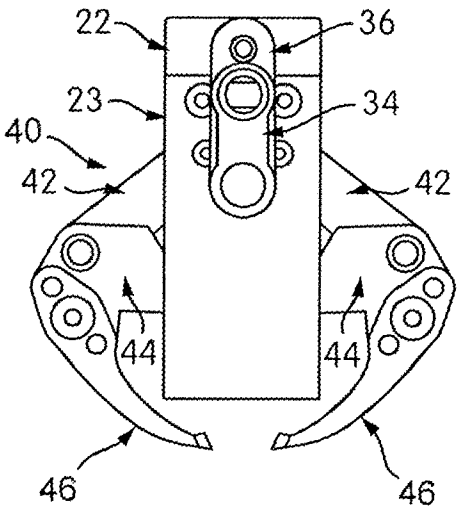
FIG. 5 illustrates the fastener closing mechanism of the embodiment of FIG. 1 in the closed position.

FIGS. 3, 4, and 5 show the driving assembly and fastener closing mechanism in the form of a clinching assembly that drives and clinches, respectively, the staple into the workpiece. FIG. 3 shows the driving assembly in the upstroke position where the clinching assembly is in the open position. FIG. 4 show the progression of the driving and clinching assemblies and how they move toward the downward stroke. FIG. 5 illustrates the driving assembly in the downward stroke wherein the clinching assembly is positioned to be closed around a staple.

The crank arm 34 rotates using power provided by the motor 26 to the gear reduction mechanism 28. Rotation of the crank arm 34 pulls and pushes a connecting rod 36 around an upper pivot pin 37, which translates the circular motion of the connecting rod into the linear reciprocating motion of a driver mounting block 22, which may be referred to as a mount. The driver mounting block 22 is linked to the driver blade 23, which pushes the staple into the workpiece. In an embodiment, the driver mounting block 22 may be integral with the driver blade 23. The driver mounting block 22 additionally pushes a pair of clincher linkages 42 in an outward direction away from the driver mounting block. At the end of each clincher linkage is a clincher arm that is pivotable about a pivot pin 48 on the clincher linkage 42. The pivotable movement of the clincher arm forces clincher anvils 46 toward each other to close the clinching assembly around the staple forcing the staple legs to bend toward each other to close the staple in position within the workpiece.

Figure 7:
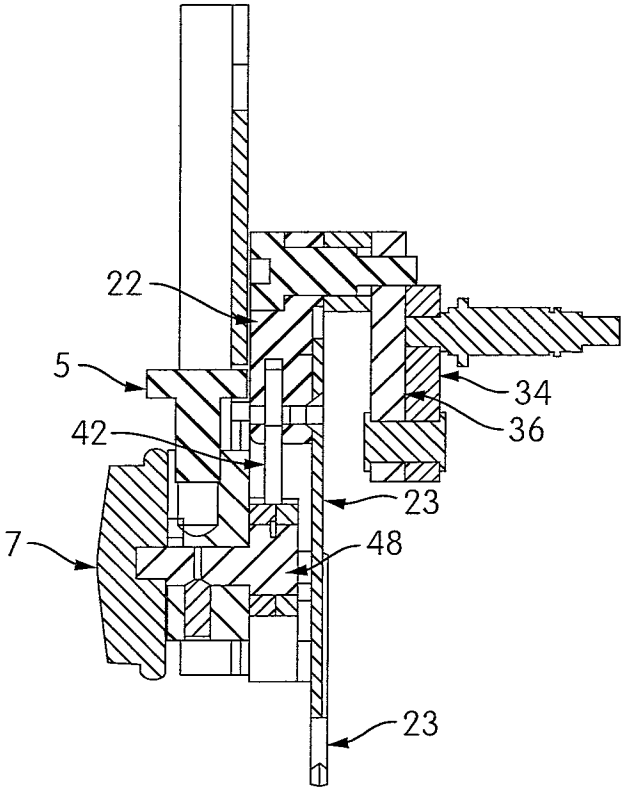
FIG. 7 illustrates a cross-sectional view of the clinching mechanism in the downstroke position.
Figure 6:
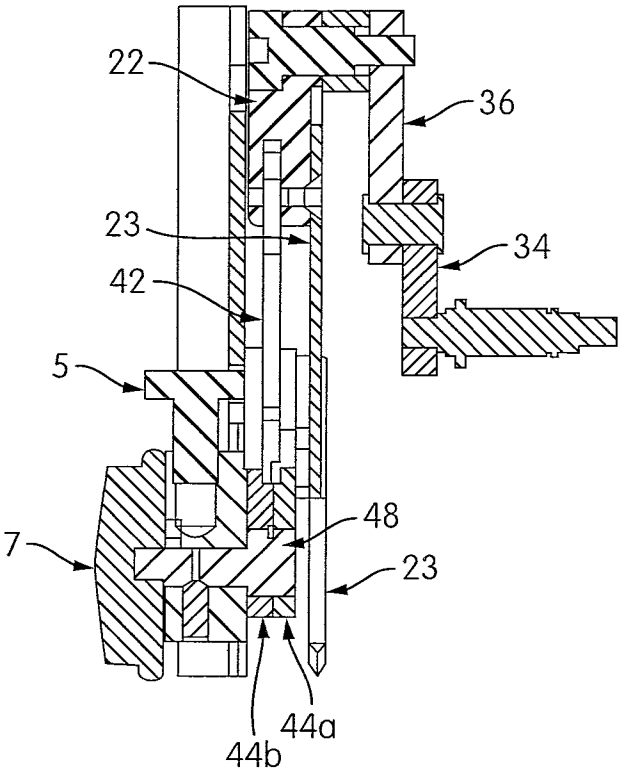
FIG. 6 illustrates a cross-sectional view of the clinching mechanism in the upstroke position.

FIGS. 6 and 7 show the driving and clinching mechanism in a cross-sectional view, During operation, the crank arm 34 is rotated by the output shaft of the motor gearbox. The crank arm pulls a connecting rod 36, which translates the rotation into a linear reciprocating motion of a driver mounting block 22. The driver mounting block in turn pushes the driver 23, which pushes the staple into the workpiece. The driver mounting block additionally pushes two clincher linkages 42 which in turn rotate two clincher arms 44 about a pivot pin 48 in order to clinch the staple legs.

Figure 9:
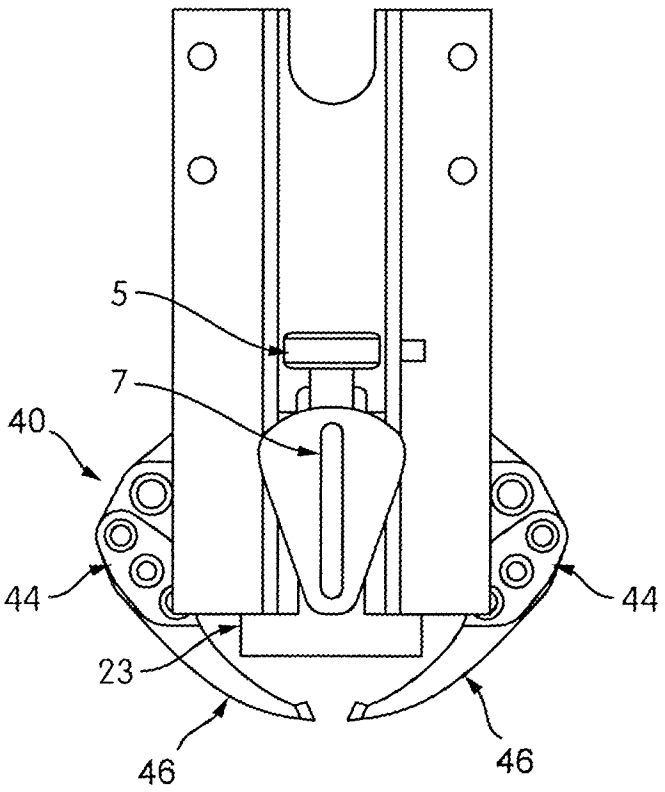
FIG. 9 illustrates a front view of the driving and clinching mechanisms with the leg length adjustment for a second leg setting.
Figure 8:
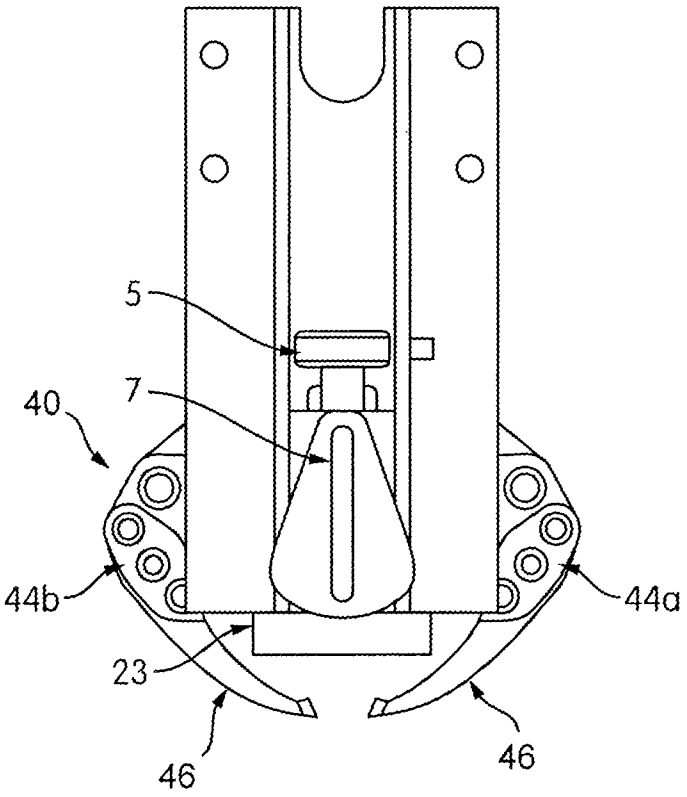
FIG. 8 illustrates a front view of the driving and clinching mechanisms with the leg length adjustment for a first leg setting.

FIGS. 8 and 9 show the driver blade 23 and clincher arms 44, namely clincher arm 44*a* and clincher arm 44*b*, at the bottom of the drive stroke in two different positions for driving staples of different leg lengths. In FIG. 8, the leg length adjustment dial 7 is set in a first setting for a first length staple leg. In FIG. 9, the leg length adjustment dial 7 is set in a second setting for a second length staple leg. In an embodiment, the first length staple can be shorter than a second length staple. Alternatively, in an embodiment, the first length staple can be longer than the second length staple. Long leg staples have legs that longer than the short leg staples, and allow for deeper penetration into thicker workpieces. The leg length adjustment dial 7 controls the depth of the clinch to accommodate workpieces of different thicknesses by changing the centers of rotation for the clincher arms 44, within the tool, to be closer to the workpiece. Accordingly, when the user turns the leg length adjustment dial 7 by hand, the dial 7 rotates the lower pivot pin 48 180-degrees, which changes the centers of rotation for the clincher arms 44 vertically and horizontally via two cam lobes 56, 58 on the pivot pin 48. In the long leg setting, the clincher anvils 46 extend deeper into the workpiece and come closer to each other than in the short-leg setting as a result of the centers of rotation moving lower and horizontally towards the opposite clincher arms 44.

FIGS. 10 and 11 further show the leg length adjustment mechanism described above. In FIG. 10, the pivot pin 48 is in a long leg setting. In FIG. 11, the pivot pin 48 is in a short leg setting. The pivot pin 48 has two cam lobes 56, 58. The cam lobes 56, 58 serve as the centers of rotation for the clincher arms 44, which clinch the staple during tool actuation. In FIG. 10, the cam lobes 56, 58 are disposed at a position higher in the tool, that is, further from the workpiece than the pivot pin 48. The axes L1 of the cam lobes are therefore higher than the axis of the pivot pin in FIG. 10. Each on the respective side of its mating clincher arm 44*a*, 44*b*. This causes the clincher arms 44*a*, 44*b* to be positioned further within the tool with respect to the workpiece and further apart at the conclusion of the downstroke. In FIG. 11, the cam lobes 56, 58 are shown at a 180 degree difference from that of FIG. 10, The cam lobes in FIG. 11 are lower in the tool, that is, closer to the workpiece than the pivot pin. The axes L2 of the cam lobes are therefore lower than the axis of the pivot pin in FIG. 11. Accordingly, the clincher arms are closer together at the conclusion of the downstroke.

Figure 13:
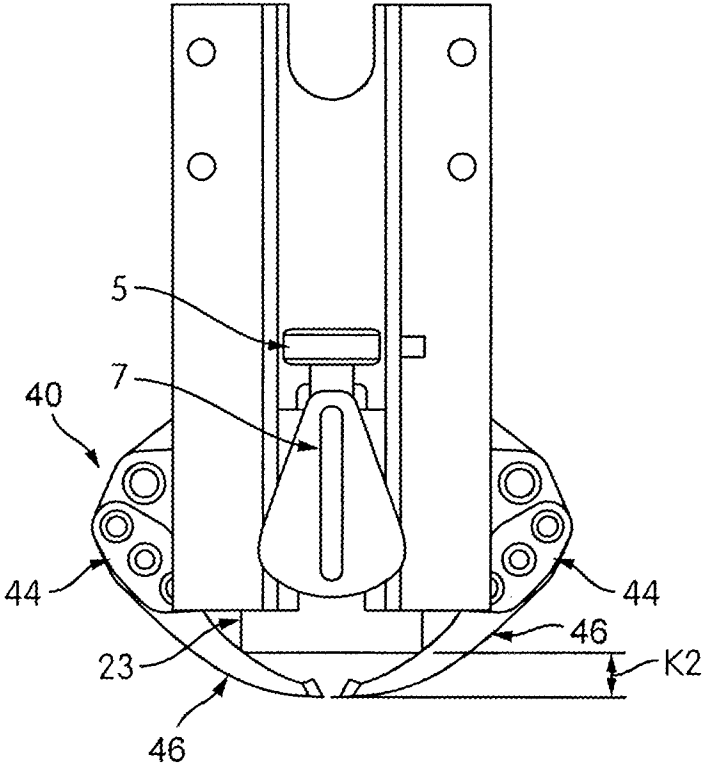
FIG. 13 illustrates a front view of the driving and clinching mechanisms with the clinch adjustment knob in a second setting.
Figure 12:
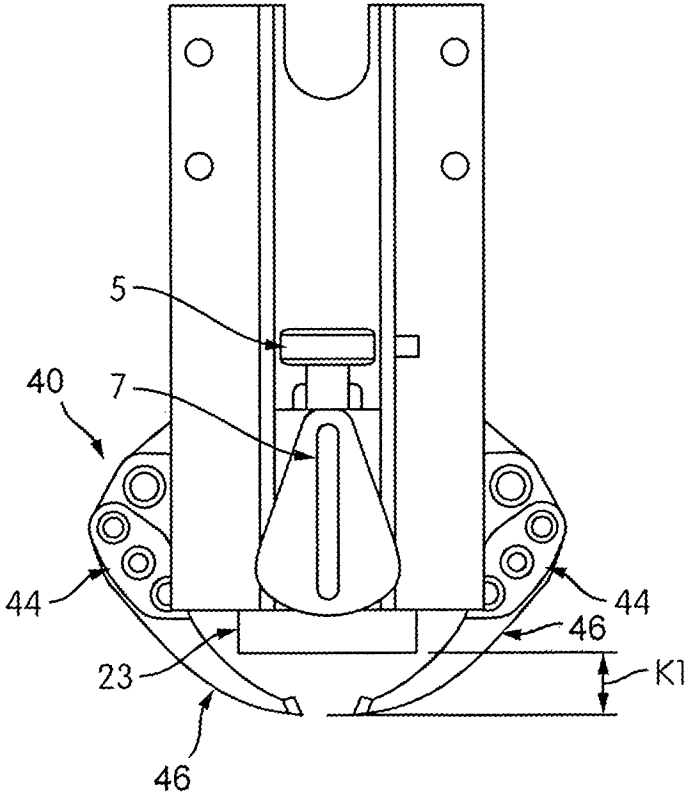
FIG. 12 illustrates a front view of the driving and clinching mechanisms with the clinch adjustment knob in a first setting.

FIGS. 12 and 13 show the driver blade 23 and clincher arms 44 at the bottom of the drive stroke as the clinch tightness adjustment is made. FIG. 12 shows the clinch adjustment knob 5 set to a loose clinch, and FIG. 13 shows the knob set to a tight clinch. When the user rotates the clinch adjustment thumbwheel, the lower pivot pin 48 is moved vertically, which in turn moves the centers of rotation for the clincher arms 44 vertically. The effect of this movement is that, at the bottom of the drive stroke, the clincher arms 44 are closer to the driver blade 23 by a distance K2, and the clincher anvils 46 are closer together in FIG. 13 as compared to FIG. 12, where the clincher arms are farther from the driver blade by a distance K1.

Figure 15:
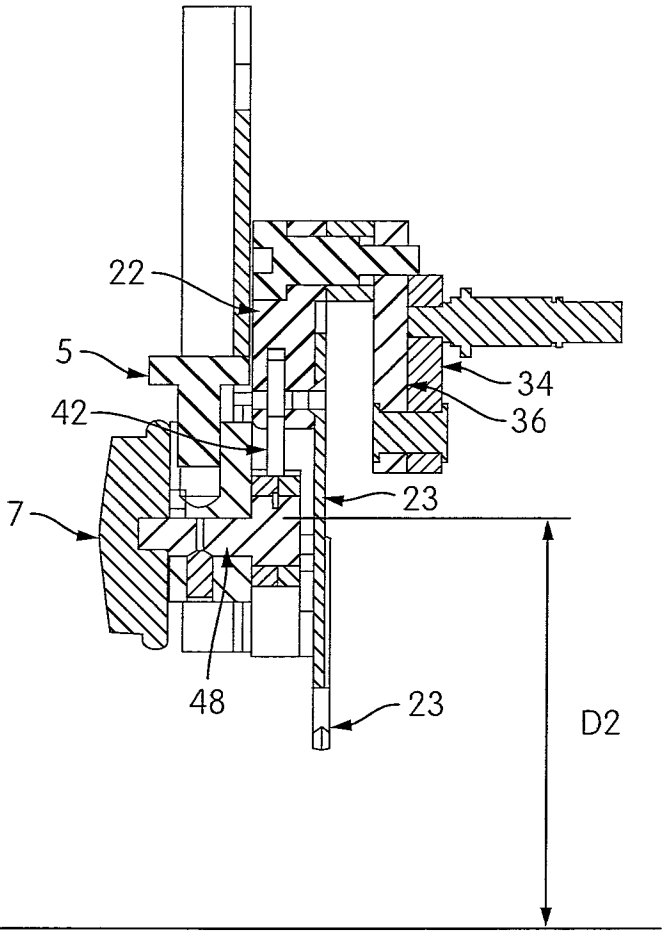
FIG. 15 illustrates a cross-sectional view of the driving and clinching mechanisms with the clinching mechanism with the clinch adjustment knob in a second setting.
Figure 14:
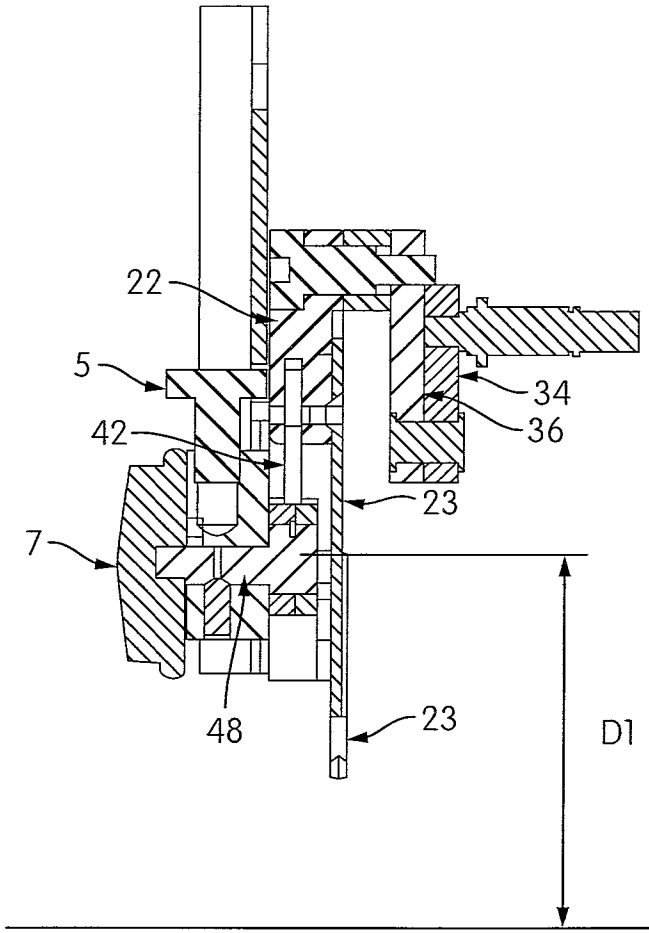
FIG. 14 illustrates a cross-sectional view of the driving and clinching mechanisms with the clinching mechanism with the clinch adjustment knob in a first setting.

FIGS. 14 and 15 show the clinch adjustment in a loose setting and tight setting, respectively. In a loose setting, at the bottom of the drive stroke, the clincher arms are farther apart from each other than in a tight setting where the clincher arms are closer to each other. The pivot pin 48 and the clinch adjustment thumbwheel 5 are moved. In FIG. 15, the pivot pin 48 is positioned higher in the tool, that is, a distance D2 that is further from the workpiece, as compared to distance D1 in FIG. 14. The placement of the pivot pin farther away from the workpiece causes the clincher arms 44 to pivot further inward, thus coming closer to each other during the clinching of the staple and closer to the driver blade 23 than the arrangement of the clincher arms 44 in FIG. 14.

Figure 17:
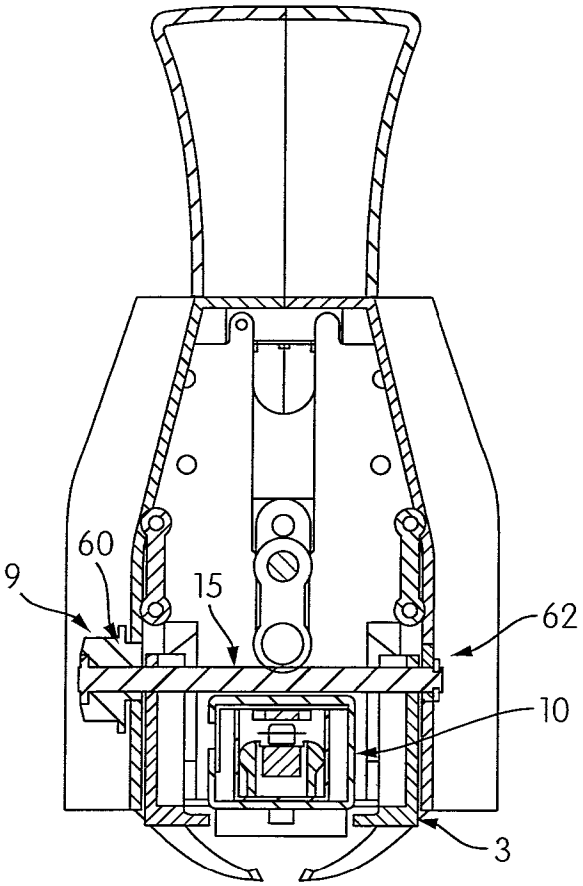
FIG. 17 illustrates a rear cross-sectional view of the tool in a second depth of drive adjustment position.
Figure 16:
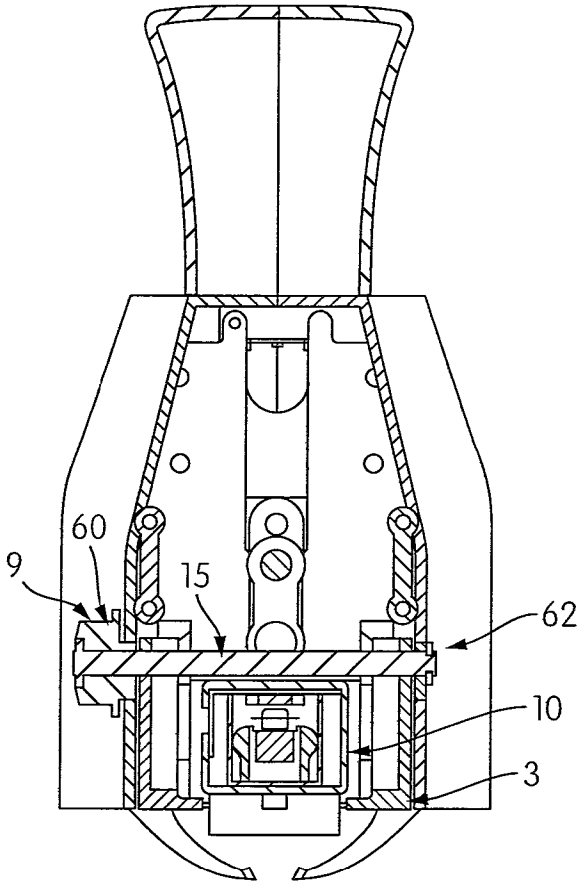
FIG. 16 illustrates a rear cross-sectional view of the tool in a first depth of drive adjustment position.

FIGS. 16 and 17 show the tool from the rear in a cross-sectional view as the depth of drive adjustment is made. The depth of drive adjustment dial 9 is rotated by hand, which turns a drive adjustment shaft 15. The drive adjustment shaft 15 turns a pair of depth of drive cam lobes 60, 62 on each side of tool which raises and lower the housing 4 of the tool. As shown in FIG. 16, the depth of drive cam lobe 60 is integral with the depth of drive dial 9. Alternatively, the cam lobe 60 can be separate from the dial 9. The depth of drive cam lobe 62 is located at an opposite side of the shaft 15. Raising and lowering of the housing 4 of the tool also moves the motor-gear reduction housing, the driving assembly and the clinching assembly vertically with respect to the staple magazine 10 and base 3.

The fastener driving device described here represents an improvement over stapling machines of the movable anvil type which typically require tools for the adjustment of staple size or drive characteristics. The device contains features for adjustment of the staple leg length, clinch tightness, and depth of drive which can be operated in the absence of tools.

Furthermore, while aspects of the present invention are described herein and illustrated in the accompanying drawings in the context of a fastening tool, those of ordinary skill in the art will appreciate that the invention, in its broadest aspects, has further applicability.

It will be appreciated that the above description is merely exemplary in nature and is not intended to limit the present disclosure, its application or uses. While specific examples have been described in the specification and illustrated in the drawings, it will be understood by those of ordinary skill in the art that various changes may be made and equivalents may be substituted for elements thereof without departing from the scope of the present disclosure as defined in the claims. Furthermore, the mixing and matching of features, elements and/or functions between various examples is expressly contemplated herein, even if not specifically shown or described, so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present disclosure not be limited to the particular examples illustrated by the drawings and described in the specification as the best mode presently contemplated for carrying out the teachings of the present disclosure, but that the scope of the present disclosure will include any embodiments falling within the foregoing description and the appended claims.

What is claimed is:

1. A fastener driving tool, comprising:

a housing;

a magazine connected to the housing and configured to hold a supply of fasteners and to provide a leading fastener to be driven;

a driver configured to move downward in the housing and drive the leading fastener into a workpiece during a drive stroke, and upward in the housing during a return stroke;

a mount connected to the driver;

a motor;

a crank arm operatively connected to the motor and configured to be rotated by the motor;

a rod rotatably connected to the crank arm at one end thereof and rotatably connected to the mount at another end thereof, wherein the rod is arranged to translate circular motion of the crank arm into linear motion of the mount during the drive stroke and during the return stroke;

a clinching assembly operatively connected to the housing and to the mount, the clinching assembly being configured to engage the leading fastener during the drive stroke and move into a clinching position at the end of the drive stroke to clinch the fastener to the workpiece;

a first adjuster configured to adjust the clinching assembly to accommodate fasteners having different lengths, wherein the first adjuster comprises a leg length adjustment dial configured to be rotated to a first setting for a first length leg of a staple to be driven by the driver and clinched by the clinching assembly, and to be rotated to a second setting for a second length leg of a staple to be driven by the driver and clinched by the clinching assembly, wherein the leg length adjustment dial is constructed and arranged to protrude outwardly from the housing to facilitate manual manipulation of the leg length adjustment dial by a user to operate the first adjuster to adjust the clinching assembly to accommodate fasteners having different lengths, and a second adjuster configured to adjust the clinching assembly to adjust the tightness of legs of the staple being clinched to the workpiece, the second adjuster comprising a variable clinch adjustment dial, wherein the variable clinch adjustment dial is an independent structure from the leg length adjustment dial, wherein the clinching assembly comprises:

a first link pivotably connected to the mount, and a second link pivotably connected to the mount;

a first clincher arm pivotably connected to the first link and pivotably connected to the housing, and a second clincher arm pivotably connected to the second link and pivotably connected to the housing; and a first clincher anvil connected to the first clincher arm at a first end thereof, and a second clincher anvil connected to the second clincher arm at a first end thereof, wherein a second end of the first clincher anvil and a second end of the second clincher anvil are each configured to move downwardly and inwardly towards each other to engage the leading fastener during the drive stroke and clinch the leading fastener to the workpiece at the end of the drive stroke, wherein the variable clinch adjustment dial of the second adjuster is configured to be rotated to a first setting for increasing the tightness of the clinched legs of the staple, and to be rotated to a second setting for decreasing the tightness of the clinched legs of the staple, and wherein rotation of the variable clinch adjustment dial changes centers of rotation of at least one of the first clincher arm and the second clincher arm vertically.

2. The fastener driving tool according to claim 1, wherein rotation of the leg length adjustment dial changes centers of rotation of at least one of the first clincher arm and the second clincher arm both vertically and horizontally.

3. The fastener driving tool according to claim 1, wherein the first clincher anvil and the second clincher anvil each have an arcuate shape and extend accurately downwardly from the respective second ends of the first clincher arm and the second clincher arm.

4. The fastener driving tool according to claim 3, wherein the first clincher anvil and the second clincher anvil are each configured to pierce through the workpiece as the first clincher anvil and the second clincher anvil move downwardly and inwardly into the clinching position.

5. The fastener driving tool according to claim 1, wherein the variable clinch adjustment dial comprises engagement surfaces constructed and arranged to protrude outwardly from the housing to enable the user to engage the engagement surfaces to operate the second adjuster to adjust the clinching assembly so as to adjust the tightness of legs of the staple clinched into the workpiece.

6. A fastener driving tool, comprising:

a housing;

a magazine connected to the housing and configured to hold a supply of fasteners and to provide a leading fastener to be driven;

a driver configured to move downward in the housing and drive the leading fastener into a workpiece during a drive stroke, and upward in the housing during a return stroke;

a mount connected to the driver;

a motor;

a crank arm operatively connected to the motor and configured to be rotated by the motor;

a rod rotatably connected to the crank arm at one end thereof and rotatably connected to the mount at another end thereof, wherein the rod is arranged to translate circular motion of the crank arm into linear motion of the mount during the drive stroke and during the return stroke;

a clinching assembly operatively connected to the housing and to the mount, the clinching assembly being configured to engage the leading fastener during the drive stroke and move into a clinching position at the end of the drive stroke to clinch the fastener to the workpiece;

a first adjuster configured to adjust the clinching assembly so as to adjust the depth to which a staple can penetrate the workpiece;

a second adjuster configured to adjust the clinching assembly to accommodate fasteners having different lengths, wherein the second adjuster comprises a leg length adjustment dial configured to be rotated to a first setting for a first length leg of a staple to be driven by the driver and clinched by the clinching assembly, and to be rotated to a second setting for a second length leg of a staple to be driven by the driver and clinched by the clinching assembly; and a third adjuster configured to adjust the clinching assembly to adjust the tightness of legs of the staple being clinched to the workpiece, the third adjuster comprising a variable clinch adjustment dial, wherein the first adjuster comprises a depth adjustment dial that is constructed and arranged to facilitate manual manipulation of the depth adjustment dial by a user to operate the adjuster to adjust the clinching assembly so as to adjust the depth to which the staple can penetrate the workpiece, wherein the clinching assembly comprises:

a first link pivotably connected to the mount, and a second link pivotably connected to the mount;

a first clincher arm pivotably connected to the first link and pivotably connected to the housing, and a second clincher arm pivotably connected to the second link and pivotably connected to the housing; and a first clincher anvil connected to the first clincher arm at a first end thereof, and a second clincher anvil connected to the second clincher arm at a first end thereof, wherein a second end of the first clincher anvil and a second end of the second clincher anvil are each configured to move downwardly and inwardly towards each other to engage the leading fastener during the drive stroke and clinch the leading fastener to the workpiece at the end of the drive stroke, wherein the leg length adjustment dial is constructed and arranged to protrude outwardly from the housing to facilitate manual manipulation of the leg length adjustment dial by the user to operate the second adjuster to adjust the clinching assembly to accommodate fasteners having different lengths, and wherein the leg length adjustment dial is an independent structure from the depth adjustment dial, wherein the variable clinch adjustment dial is an independent structure from the leg length adjustment dial and the depth adjustment dial, and wherein rotation of the variable clinch adjustment dial changes centers of rotation of at least one of the first clincher arm and the second clincher arm vertically.

7. The fastener driving tool according to claim 6, wherein the adjustment dial is configured to be rotated between a range of adjustment positions so as to adjust the depth to which the staple can penetrate the workpiece.

8. The fastener driving tool according to claim 6, wherein the adjustment dial is configured to move the clinching assembly vertically with respect to the magazine.

9. The fastener driving tool according to claim 6, wherein rotation of the leg length adjustment dial changes centers of rotation of at least one of the first clincher arm and the second clincher arm both vertically and horizontally.

10. The fastener driving tool according to claim 6, wherein the variable clinch adjustment dial of the third adjuster is configured to be rotated to a first setting for increasing the tightness of the clinched legs of the staple, and to be rotated to a second setting for decreasing the tightness of the clinched legs of the staple.

11. The fastener driving tool according to claim 6, wherein the variable clinch adjustment dial comprises engagement surfaces constructed and arranged to protrude outwardly from the housing to enable the user to engage the engagement surfaces to operate the third adjuster to adjust the clinching assembly to adjust the tightness of legs of the staple clinched into the workpiece.

* * * * *